United States Patent [19]

Panek et al.

[11] 3,963,297

[45] June 15, 1976

[54] UNDERWATER PRESSURE COMPENSATED ELECTRICAL CONNECTOR

[75] Inventors: George J. Panek, Phoenix, Ariz.; Gerald J. Selvin, Huntington Beach, Calif.

[73] Assignee: International Telephone and Telegraph Corporation, New York, N.Y.

[22] Filed: Oct. 1, 1975

[21] Appl. No.: 618,344

[52] U.S. Cl. ..... 339/94 M; 174/12 R; 339/117 R

[51] Int. Cl.[2] ..... H01R 13/52

[58] Field of Search ..... 339/94, 96, 117; 174/12 R, 21 R, 21 JS, 70 S

[56] References Cited

UNITED STATES PATENTS

| | | | |
|---|---|---|---|
| 3,508,188 | 4/1970 | Buck | 339/117 R |
| 3,520,985 | 7/1970 | Jarvis | 174/70 S |
| 3,601,769 | 8/1971 | Oliver et al. | 339/94 M |

FOREIGN PATENTS OR APPLICATIONS

| | | | |
|---|---|---|---|
| 274,176 | 9/1970 | U.S.S.R. | 339/94 R |

*Primary Examiner*—Joseph H. McGlynn
*Attorney, Agent, or Firm*—Thomas L. Peterson

[57] ABSTRACT

An underwater electrical connector having an oil filled chamber in one connector member behind the insulator therein in which the contacts are mounted. A pressure compensating bellows is mounted in the wall of the housing of the connector member. An adjustable piston is also mounted in the wall of the housing for establishing a predetermined pressure on the oil in the chamber, whereby the bellows is preloaded thereby enhancing the pressure compensating characteristics of the bellows.

6 Claims, 1 Drawing Figure

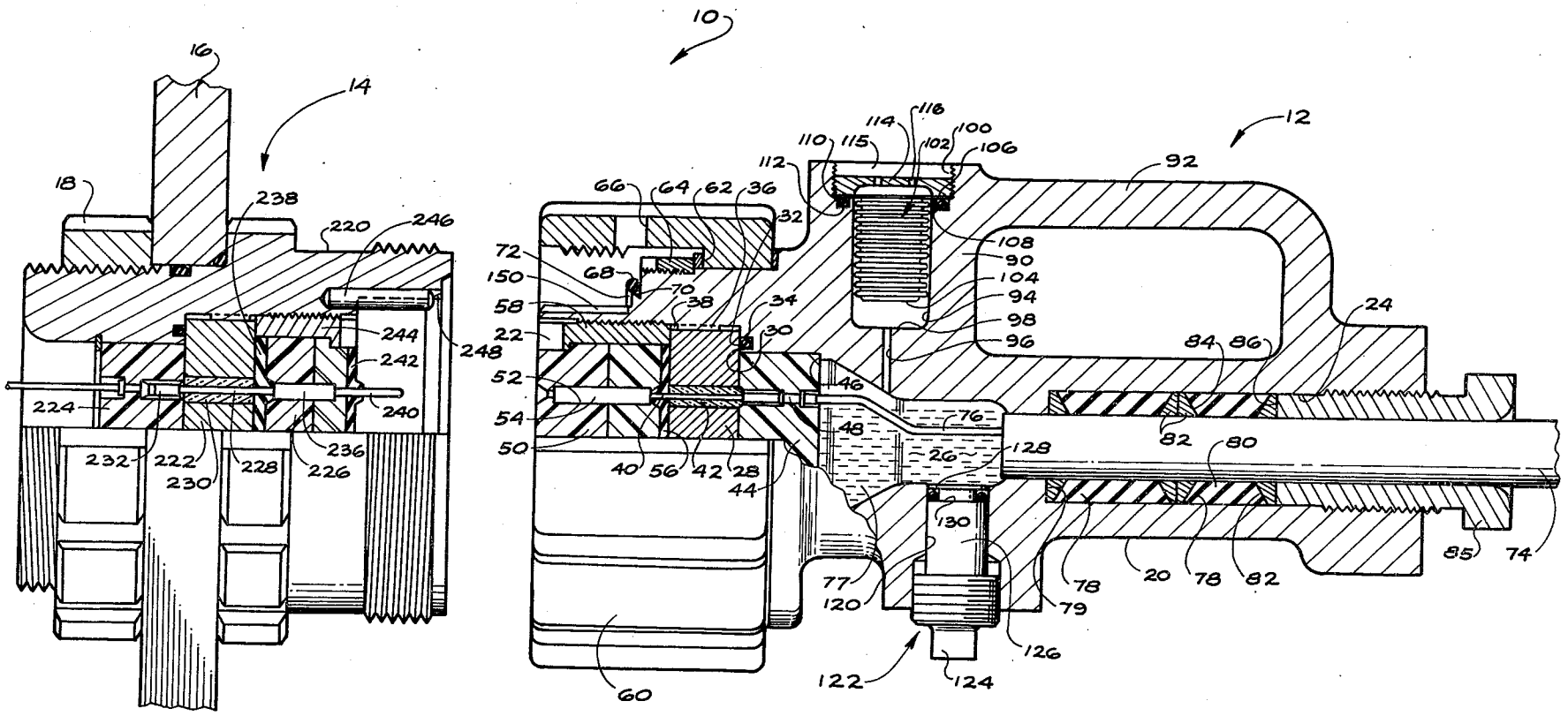
10
12
14
16
18
20
22
24
26
28
30
32
34
36
38
40
42
44
46
48
50
52
54
56
58
60
62
64
66
68
70
72
74
76
77
78
79
80
82
84
85
86
90
92
94
96
98
100
102
104
106
108
110
112
114
115
116
120
122
124
126
128
130
150
220
222
224
226
228
230
232
236
238
240
242
244
246
248

UNDERWATER PRESSURE COMPENSATED ELECTRICAL CONNECTOR

BACKGROUND OF THE INVENTION

This invention relates generally to an electrical connector and, more particularly, to pressure compensated underwater electrical connector.

It is known in the art of underwater electrical connectors to provide an oil filled chamber in the connector to prevent the surrounding medium, such as sea water, from entering into the interior of the connector which may cause shorting of the connection system. U.S. Pat. No. 3,750,088 discloses the use of a movable rubber diaphragm for providing pressure compensation between the oil filled chamber in the connector and the exterior environment to prevent leakage into the connector. A rubber diaphragm is not always entirely satisfactory for providing pressure compensation, particularly in very high pressure environments, since the diaphragm, being somewhat fragile, may rupture. Further, even with the use of a diaphragm, some sea water may leak into the interior of the connector, particularly along the surface of the cable which extends through the wall of the housing of the connector.

It is the purpose of the present invention to overcome the attendant disadvantages of the prior art pressure compensated electrical connectors by providing a connector having a presure compensating device therein combined with means for establishing a predetermined positive pressure in the interior of the connector, thereby preloading the pressure compensating device so that the volume displacement capability of the pressure compensating device is greatly enhanced.

SUMMARY OF THE INVENTION

According to the principal aspect of the present invention, there is provided an underwater electrical connector member in which the housing of the connector member is formed with an oil filled chamber behind the insulator in the connector member in which the contacts are mounted. A cable extends into the chamber through a passage in the wall of the housing and contains conductors which are terminated to the contacts in the insulator. A pressure compensating bellows is mounted in a bore in the wall of the housing. An axially adjustable piston is slidably mounted in a second bore in the housing wall. The piston is utilized for establishing a predetermined pressure on the oil in the chamber, thereby preloading the bellows so that the pressure compensating characteristics of the bellows is increased. A positive pressure is applied to the oil in the chamber by the piston so that water outside of the connector member cannot leak thereinto between the surface of the cable and the passage in which it is mounted, or in any other areas of the connector.

BRIEF DESCRIPTION OF THE DRAWING

The drawing illustrates an underwater electrical connector in accordance with the present invention, shown in partial longitudinal section with the connector members disengaged.

DESCRIPTION OF THE PREFERRED EMBODIMENT

Referring now to the drawing in detail, there is illustrated the underwater electrical connector of the present invention, generally designated 10. The connector comprises a plug connector member 12 and a mating receptacle connector member 14. The receptacle connector member is mounted to a panel or bulkhead 16 by means of a retaining nut 18.

The plug connector member 12 comprises a one piece housing 20 having a general cylindrical recess 22 at its forward end, a generally cylindrical passage 24 at its rear end, both communicating with a chamber 26 within the interior of the housing. A metal header 28 is mounted in the recess 22 and abuts against a shoulder 30 formed in the wall of the housing 20. An O-ring 32 is mounted in an annular groove 34 opening at the shoulder 30 providing a sealing engagement between the header 28 and the shoulder. The outer periphery of the header 28 is formed with longitudinally extending keys 36 which engage within keyways 38 formed on the wall of the recess for proper positioning of the header in the housing. Only one of such key and keyway arrangements is illustrated in the drawing. A plurality of double-ended pin contacts 40 are mounted in the header 28 by compression glass seals 42, only one of such contacts and seals being illustrated in the drawing. It is noted that the opposite ends of the pin contact extend beyond the forward and rear faces of the header 28. An insulator 44 is positioned behind the header 28. The rear of the insulator engages a shoulder 46 on the interior of the housing 20. A socket contact 48 in the insulator 44 slidably engages the pin contact 40 extending rearwardly from the header 28. The socket contact 48 may be releaseably retained in the insulator 44 by means of a front release, rear removable contact retention assembly such as disclosed in U.S. Pat. No. 3,172,721. Any other suitable form of contact retention assembly may be utilized. A two piece front insulator 50 is mounted in the recess 22 in front of the header 28. The insulator 50 has a plurality of longitudinally extending bores 52 therein each aligned with an individual one of the pin contacts 40. A double-ended socket contact 54 is mounted in each of the bores 52. The forward end of the pin contact 40 slidably engages within the rear portion of the socket contact 54. A rubber interfacial seal 56 is interposed between the header 28 and the insulator 50. The insulator 50 and header 28 are retained within the recess 22 of housing 20 by means of an externally threaded retaining ring 58.

A coupling nut 60 is rotatably mounted on the forward end of the connector housing 20. The nut is retained on the housing by a snap ring 62 and a threaded retaining ring 64. It will be appreciated that by removing the retaining rings 58, 64 the insulators, header, contacts, and coupling nut may be removed from the connector member 12 for replacement as required. A site hole 66 is provided in the coupling nut 60 so that the user can verify that full mating of the plug connector member 12 is made with the receptacle connector member 14. A resilient O-ring 68 is positioned in an annular groove 70 on a forwardly facing shoulder 72 of connector housing 20 for making a sealing engagement with the shell of the receptacle connector member 14.

A cable 74 extends through the passage 24 in the housing 20. The cable contains a plurality of conductors 76, only one being shown in the drawing, each connected to a corresponding socket contact 48. It is noted that each conductor 76 passes through the chamber 20 within the interior of the housing. This chamber contains an electrically non-conducting liquid 77, such as oil, to protect the contacts 48 from any leakage which might occur between the cable 74 and the passage 24 in which it is mounted. Two cylindrical resilient sealing members 78 are mounted in the passage 24 surrounding the cable. The forward sealing member abuts against a rearwardly facing shoulder 79 formed in the wall of the passage 24. Each sealing member comprises a rubber ring 80 with a pair of pressure rings 82 on the axial ends of the rubber ring. Each pressure ring has a tapered inner face 84 bonded to its respective rubber ring 80. A hollow cylindrical bushing 85 surrounding cable 74 is threadedly engaged within the rear of the passage 24. It will be appreciated that when the bushing is threaded into the passage the forward end 86 of the bushing will abut against the adjacent pressure ring 82, thereby exerting an axial force upon each of the sealing members 78. Such axial force causes radial deformation of the rubber rings 80 thereby effecting a liquid tight seal between the wall of the passage 24 and the outer surface of the cable 74.

The housing 20 of the plug connector member 12 is formed with an upperwardly extending boss 90. Handle 92 extends rearwardly from the boss to the rear of the housing. The boss is formed with a cylindrical bore 94. A narrow passage 96 extends from the bottom 98 of the bore to the chamber 26. A threaded counterbore 100 is formed in the outer end of the boss 90. A metal bellows 102 is mounted in the bore 94. The inner end 104 of the bellows adjacent to the bottom 98 of the bore is closed while the outer end of the bellows is open. The outer end of the bellows is formed with an outwardly extending annular flange 106 which is positioned against the bottom 108 of the counterbore. An O-ring 110 mounted in an annular groove 112 sealingly engages the bottom of the flange 106. A rigid perforated protective disc 114 is threaded in the counterbore 100. The disc engages the flange 106 to securely fix the outer end of the bellows to the housing. A slot 115 is formed in the outer side of the disc 114 for receiving a tool to facilitate threading of the disc in the counterbore 100. The interior of the bellows is in communication with the exterior environment of the connector member 12 via openings 116 in the disc 114. It will be appreciated that the bellows provides pressure compensation between the outside of the connector member and the oil filled chamber 26. The bellows will not rupture, as would a rubber diaphragm, when the connector member is subjected to high external pressures because the bellows is more rugged and the closed inner end 104 of the bellows will abut the bottom 98 of the bore 94 prior to excessive expansion thereof. The bottom 98 of the bore therefore functions as a protective stop for the bellows.

A cylindrical bore 120 is also formed in the wall of the housing 20. The bore 120 opens into the chamber 26. A plug 122 is threadedly engaged in the bore. The plug has a square outer head 124 for facilitating the use of a suitable tool for the tightening and untightening of the plug in the bore. The removal of the plug 122 from the bore permits the filling and purging of the chamber 26 with oil. The inner end of the plug is formed as a piston 126. An O-ring 128 is mounted in an annular groove 130 in the wall of the piston.

Typically, the metal bellows 102 will permit about 10% volume displacement capability for the oil filled chamber 26, that is, about 10% pressure compensation. By the provision of the piston 126 on the plug 122, the user may establish a predetermined positive pressure on the oil in the chamber 26 thereby assuring that water cannot leak into the chamber via the passage 24 in which the cable 74 is mounted or at the front contact end of the connector. Further, the pressurization of the oil within the chamber by the piston 126 preloads or compresses the bellows 102, thereby permitting a breater stroke of the bellows within the bore 94. As a consequence, the bellows preloaded by the piston 126 will produce an approximately 10% additional pressure compensation for the connector, so that there will be an approximately 20% volume displacement capability by the use of the combination of the bellows with the adjustable piston 126. It will be appreciated that the foregoing percentage figures are given by way of example only, and not by limitation. By this arrangement, the connector of the present invention is suitable for use in high pressure environments of about 10,000 psi without leakage and resulting electrical failure occurring. It will be appreciated that because the bellows is mounted entirely within the bore 94 in boss 90 the bellows is totally protected from possible damage during normal use of the connector member 12.

The mating receptacle member 14 comprises a shell 220 containing a header 222, rear insulator 224, and two-piece front insulator 226 essentially identical to the header 28, rear insulator 44 and insulator 50 in the plug connector member 12. A double-ended pin contact 228 is mounted in the header 222 aligned with each of the double socket contacts 54 in the plug connector member. Each pin contact 228 is sealed in the header by means of a glass seal 230. A socket contact 232 in the rear insulator 224 is connected to a conductor 232 and slidably engages with the rear of the pin contact 228. A second socket contact 236 is mounted in the front insulator 226, and slidably engages with the forward end of the pin contact 228. An interfacial seal 238 is positioned between the insulator 226 and the header 222. The contact 236 is formed with a forwardly extending pin contact 240 which extends through an interfacial seal 242 on the front face of the insulator 226. The pin contact 240 engages with the socket contact 54 in the plug connector member 12 when the latter is coupled to the receptacle member 14. The header 222 and front insulator 226 are retained in the shell 220 by a threaded retaining ring 244. A polarizing key 246 extends forwardly into a recess 248 in the forward end of the shell 220. This pin engages in a mating keyway 150 on the forward end of the housing of the plug connector member 12. Preferably three such keying arrangements are provided on the plug and receptacle connector members to provide polarization for the connector.

It will be appreciated that by the interfacial seals 56 and 238 in the plug and receptacle connector members, respectively, individual seals are provided for each pin and socket connection. Besides each contact seal, the secondary interfacial seal 242 on the receptacle connector member provides double assurance against leakage of water into the interior of the connectors through the contact mating ends thereof. The use of the socket contacts 54 and 236 in the plug and receptacle connector members, respectively, also assures that the hermetically sealed pin contacts 40 and 228 are protected during the mating and unmating cycle of the connector.

What is claimed is:

1. An underwater electrical connector member comprising:

a housing containing an insulator and having a chamber therein behind said insulator adapted to hold an electrically nonconductive liquid;

at least one electrical contact mounted in said insulator;

a passage in said housing extending from said chamber to outside said housing for receiving a cable containing a conductor adapted to be connected to said contact;

first and second bores extending through the wall of said housing communicating with said chamber;

a pressure compensating bellows in said first bore having a closed end axially movable in said bore; and an axially adjustable piston slidably mounted in said second bore for establishing a predetermined pressure on said liquid in said chamber, thereby compressing said bellows.

2. An electrical connector member as set forth in claim 1 wherein:

said first bore embodies stop means between said bellows and said chamber for limiting expansion of said bellows within said bore.

3. An electrical connector member as set forth in claim 1 wherein:

said first bore has a counterbore opening to the outside of said housing; and a rigid, perforated protective disc is threadedly engaged in said counterbore.

4. An electrical connector member as set forth in claim 1 including:

a cylindrical, resilient sealing member in said passage adapted to receive said cable therethrough;

a shoulder in said passage in front of said sealing member; and a cylindrical bushing threaded into said passage from outside said housing, said bushing axially compressing said sealing member to radially deform the same into sealing engagement with the cable.

5. An electrical connector member as set forth in claim 1 wherein:

said contact comprises a double-ended socket contact;

a header is mounted in said housing behind said insulator;

a double-ended pin contact is mounted by a glass seal in said header coaxial with said socket contact and with the ends thereof extending beyond the front and rear of said header, the front end of said pin contact being slidably engaged with said socket contact;

a second insulator is mounted in said housing behind said header; and a second socket contact adapted to be connected to said cable conductor is releasably mounted in said second insulator coaxial with said pin contact and slidably receiving the rear end of said pin contact.

6. An electrical connector member as set forth in claim 5 including:

means releasably mounting said insulators, and header in said housing.

* * * * *